US011867489B2

(12) United States Patent
Beswick et al.

(10) Patent No.: US 11,867,489 B2
(45) Date of Patent: Jan. 9, 2024

(54) RELATING TO AMMUNITION

(71) Applicant: BAE SYSTEMS plc, London (GB)

(72) Inventors: Thomas Lloyd Beswick, Crewe (GB); Ian John Pennell, Crewe (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 17/904,528

(22) PCT Filed: Feb. 24, 2021

(86) PCT No.: PCT/GB2021/050455

§ 371 (c)(1),
(2) Date: Aug. 18, 2022

(87) PCT Pub. No.: WO2021/170999

PCT Pub. Date: Sep. 2, 2021

(65) Prior Publication Data

US 2023/0085286 A1 Mar. 16, 2023

(30) Foreign Application Priority Data

Feb. 27, 2020 (EP) ..... 20275050
Feb. 27, 2020 (GB) ..... 2002764

(51) Int. Cl.
*F42B 33/14* (2006.01)
*F42B 5/24* (2006.01)
(Continued)

(52) U.S. Cl.
CPC ..... *F42B 33/14* (2013.01); *F42B 5/24* (2013.01); *F42B 5/295* (2013.01); *F42B 12/80* (2013.01)

(58) Field of Classification Search
CPC ..... F42B 5/295
See application file for complete search history.

(56) References Cited

U.S. PATENT DOCUMENTS 48,536 A * 7/1865 Dodge ..... F42B 5/26
102/464
181,356 A * 8/1876 Milbank ..... B21D 22/30
86/19.5
(Continued)

FOREIGN PATENT DOCUMENTS

DE 4202235 A * 8/1992 ..... F42B 12/78
DE 4202235 A1 8/1992
(Continued)

OTHER PUBLICATIONS

International Search Report and Written Opinion received for PCT/GB2021/050455, dated May 3, 2021. 13 pages.
(Continued)

*Primary Examiner* — Derrick R Morgan
(74) *Attorney, Agent, or Firm* — FINCH & MALONEY PLLC

(57) ABSTRACT

This invention relates to a improvements relating to munitions, specifically to coating small arms ammunition with decoppering agents, as a replacement in lead free ammunition. There is a method of manufacturing a coated metallic projectile for a rifled barrel, comprising; providing a metallic projectile cup with a coating of a decoppering agent located thereon, to provide a coated metallic projectile cup; causing the coated metallic projectile cup to be drawn through a plurality of dies to form a drawn coated metallic projectile.

8 Claims, 2 Drawing Sheets

(51) Int. Cl.
*F42B 5/295* (2006.01)
*F42B 12/80* (2006.01)

(56) References Cited

U.S. PATENT DOCUMENTS 338,849 A * 3/1886 Lorenz ..... F42B 12/78 102/514
2,462,851 A * 3/1949 Fawcett ..... B21D 51/54 102/468
3,142,256 A * 7/1964 Mack ..... F42B 12/78 102/508
4,109,581 A * 8/1978 Six ..... F42B 12/74 102/501
5,847,313 A * 12/1998 Beal ..... F42B 12/74 102/516
6,209,459 B1 * 4/2001 Kaufman ..... F42B 35/00 102/501
6,371,029 B1 * 4/2002 Beal ..... F42B 12/74 102/516
6,971,315 B2 * 12/2005 Knappworst ..... F42B 12/34 102/508
8,950,333 B2 * 2/2015 Burczynski ..... F42B 12/78 102/508
10,690,465 B2 * 6/2020 Morse ..... F42B 12/367
11,408,717 B2 * 8/2022 Robbins ..... F42B 12/34
11,421,967 B2 * 8/2022 Tubb ..... F42B 5/025
11,460,279 B2 * 10/2022 Masinelli ..... F42B 12/74
2010/0175576 A1 * 7/2010 Weeks ..... F42B 12/78 102/517
2022/0097124 A1 * 3/2022 Swank ..... C21D 8/065

FOREIGN PATENT DOCUMENTS

DE 4227068 A1 2/1994
EP 0410075 A2 1/1991
EP 0499832 A1 8/1992
WO 9618862 A1 6/1996
WO 2006083309 A2 8/2006
WO 2021170999 A1 9/2021

OTHER PUBLICATIONS

Combined Search and Examination Report under Sections 17 and 18(3) received for GB Application No. 2002764.5, dated Aug. 20, 2020. 8 pages.
Extended European Search Report received for EP Application No. 20275050.1, dated Sep. 8, 2020. 7 pages.
International Preliminary Report on Patentability for PCT Application No. PCT/GB2021/050455. dated Sep. 9, 2022. 8 Pages.

* cited by examiner

RELATING TO AMMUNITION

This invention relates to improvements relating to ammunition, specifically to coating small arms ammunition with decoppering agents, as a replacement in lead free ammunition.

When a projectile is fired from a rifled barrel, the projectile must deform as it travels along the barrel, so that material forming part of the projectile is forced into the spaces between the lands that form the rifling. This process is called engraving, and causes a spin to be imparted to the projectile by virtue of the twist of the rifling.

The deformation of the projectile, its travel along the barrel effectively as a force fit to the rifling, the high linear acceleration imparted by the gun propellant on firing, and the consequent high rate of angular acceleration and associated force acting between rifling and projectile all contribute to substantial wear on the barrel. The engraved projectile produces copper, which can cause issues when it deposes on the lands and in the rifling grooves of the barrel.

The use of lead as a decoppering agent is well known. The move to using lead free munitions gives rise to issues of copper, from the projectile jackets, accumulating as deposits in the lands of a rifled barrel. The drive for the absence of lead in rounds, gives rise to a new issue that of a lack of decoppering effect.

According to a first aspect of the invention there is provided a method of manufacturing a decoppering agent coated metallic projectile, for a rifled barrel, comprising a. providing a metallic projectile cup, coating said cup with a decoppering agent, to provide a coated metallic projectile cup b. causing the coated metallic projectile cup to be drawn through a plurality of dies to form a drawn coated metallic projectile.

Cups, such as metallic projectile cups, cartridge cups, are well known precursor stock materials, ie engineering components, for the production of projectiles and cartridge cases, used in drawing processes. The metallic projectile cup may be selected from any metal, typically copper or alloys thereof, such as gilding metal.

The method provides a metallic projectile cup with a coating of a decoppering agent located thereon, to provide a coated metallic projectile cup, The thickness of said decoppering agent on the metallic projectile cup may be in the range of from 0.10 microns to 100 microns, more preferably in the range of from 1 micron to 20 microns, yet more preferably in the range of from 5 to 15 microns.

The decoppering agent may be selected from any known decoppering agent, such as for example tin, lead, bismuth, in the form of metals, alloys and their compounds, such as oxides, nitrate, subcarbonates, antimonides etc., more preferably tin and tin oxides.

The drawn coated metallic projectile comprises a drawn coated metallic jacket over an inner core. The coated metallic jacket comprises a coating of the decoppering agent, the projectile is formed by drawing the coated metallic projectile cup to form a drawn coated metallic jacket over an inner core.

The inner core may be manufactured from any material such as for example ceramics, alloys, metals. The metals may be such as, for example lead, steel, and tungsten.

The inner core may typically be in the form of a monolithic body, and the material selection will depend partly upon the function that the projectile is to perform.

For example in the case of enhanced performance munition the inner core may be a material with a high Vickers Hardness, such as for example greater than 550 HV, more preferably greater than 570 HV. High Vickers hardness materials may be, such as, metals, ceramics, carbides, and borides. The metals may be selected from hardened steel, tungsten, and their alloys thereof. Carbides may be selected from tungsten carbide. However, there is a move towards lead free rounds, preferably hardened steels may be used.

The drawn outer metallic jacket surrounds the inner core, such as the monolithic body, which defines an outer diameter of said projectile.

The drawn outer jacket, is deformable, and may typically be manufactured from a gilding metal jacket, typically copper or alloys thereof, comprising a coating of decoppering agent located thereon.

The metallic projectile cup has inner and outer walls. The inner walls when formed into the final drawn projectile abut the inner core. The outer walls of the metallic projectile cup form the outer surface of the metallic jacket. The metallic projectile cup, may be coated on the inner wall, outer wall, or entire surfaces.

The drawn outer jacket may start as a coated metallic projectile cup, which may be ductile, and therefore extrudable and may be drawn through a series of dies, and forms around the inner core.

In one arrangement the drawn outer coated metallic jacket may be located over a monolithic body which comprises one or more bands or ridges, such that there are cavities created between the drawn outer coated metallic jacket and the bands or ridges of the monolithic body.

The outer diameter of said coated metallic projectile is substantially equal to an internal diameter of the barrel defined by the lands, and wherein during firing of the projectile the lands of the rifling in the barrel deform the outer coated metallic jacket. Upon firing, deformation of the outer coated metallic jacket is designed to provide the projectile with an interference fit with the rifling lands rifling, so as to provide effective obturation by restricting or preventing the escape of propellant gases past the projectile via the rifling grooves. Regard must also be taken to ensure that the force required to effect the deformation of the jacket material and to propel the projectile along the barrel is not excessive, and therefore the diameter of the inner core, and typically the monolithic body may not be greater than that of the rifling lands.

According to a further aspect of the invention there is provided a method of manufacturing a coated metallic projectile cup, capable of forming a metallic projectile for a rifled barrel, comprising a. providing a precursor stock material with a coating of a decoppering agent located thereon, to provide a coated precursor stock material, b. causing the coated precursor stock material to be formed into a coated metallic projectile cup, by rolling, drawing, extrusion, stamping.

The decoppering agent may be applied to the precursor stock material or metallic projectile cup by electrolysis, electroless deposition, vapour deposition, chemical vapour deposition, co-depositing/alloying.

According to a further aspect of the invention there is provided a coated metallic projectile, suitable for a rifled barrel, said projectile comprising an inner core, which comprises an drawn outer coated metallic jacket, wherein said outer coated metallic jacket comprises a drawn coating of a decoppering agent thereon.

The thickness of said decoppering agent on the coated metallic projectile may be in the range of from 0.10 microns to 100 microns, more preferably in the range of from 1.0 microns to 20 microns, yet more preferably in the range of from 5 to 15 microns.

It is essential that the outer diameter (calibre) of the coated metallic projectile is not increased outside of standard tolerances. The use of the decoppering agent coated projectile cups, ensures that the methodology and process steps are adhered to as for pre-existing manufacturing drawing stations. This ensures that the final outer diameter of the metallic jacket are uniform and uniform with current manufactured (uncoated rounds).

The simple step of coating (uncoated) already formed projectiles with a decoppering agent may require some form of reduction of diameter of the uncoated projectile, to allow for the coating thickness of the decoppering agent. This may lead to changes in the steps of the drawing process. This may lead to requirements of requalification of reduced diameter rounds. The methods disclosed herein overcome and prevent need for requalification.

The use of a metallic projectile cup comprising a coating of decoppering agent, allows the direct formation of a decoppering agent coated metallic projectile. This removes the need of setting up a new process of applying a decoppering agent to a ready formed (uncoated) metallic projectile.

The outer drawn metallic jacket and decoppering agent are both drawn from a decoppering agent coated metallic projectile cup.

The decoppering agent may most conveniently be applied to the projectile, as, this is the part of the round that is exposed to the most heat, friction and interaction with the rifling. However, the cartridge case may also be coated with a decoppering reagent.

According to a further aspect of the invention there is provided a tin coated round, suitable for a rifled barrel, comprising a cartridge case, a copper jacketed projectile, propellant, and ignitor cap, wherein at least one of the cartridge case and/or copper jacketed projectile, comprises a drawn coating of a decoppering agent thereon; preferably both the cartridge case and projectile are both tin coated.

According to a further aspect of the invention there is provided a method of manufacturing a coated metallic cartridge for a rifled barrel, comprising a. providing a metallic cartridge cup with a coating of a decoppering agent located thereon, to provide a coated metallic cartridge cup, b. causing the coated metallic cartridge cup to be drawn through a plurality of dies to form a drawn coated metallic cartridge case.

In a specific arrangement, for a 7.62 mm projectile. It was found that tin plating thicknesses of 5, 10 and 15 micron coated metallic projectile cups did not significantly 'thin out' during the drawing process, along the parallel and boat tail sections of the projectile. There was a modest degree of thinning of the original plating thickness on the ogive section as you move away from the parallel section, but returns to the original plating thickness at the nose.

An arrangement of the invention will now be described by way of example and with reference to the accompanying drawings of which;—

Figure 1:
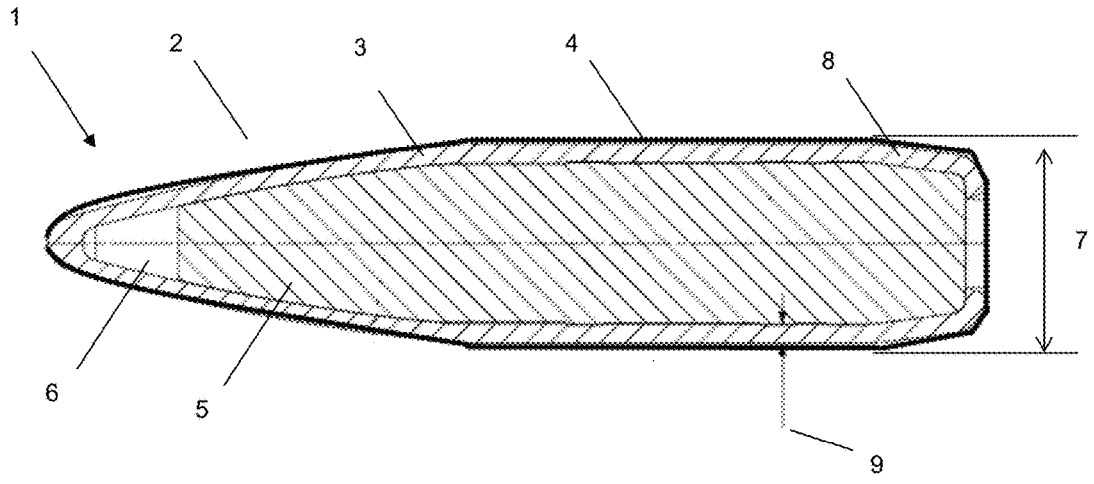
FIG. 1 shows a round with a layer of decoppering agent.

As shown in FIG. 1, a small arms round 1 comprising an inner core 5, outer jacket 3, an ogival portion 2, and a rearwardly located boat tailed portion 8.

The inner core 5, has a drawn outer jacket 3, the drawn outer jacket 3 comprises a layer of drawn decoppering agent 4, such as tin, on the exterior surface. The total outer diameter 7 defines the calibre, which is the sum of the drawn decoppering agent, drawn outer jacket and inner core.

During the drawing process, a gap 6 is often left between the inner core 5 and the drawn outer jacket 3, the gap 6 may comprise a particulate filler, air gap or ceramics.

Figure 2:
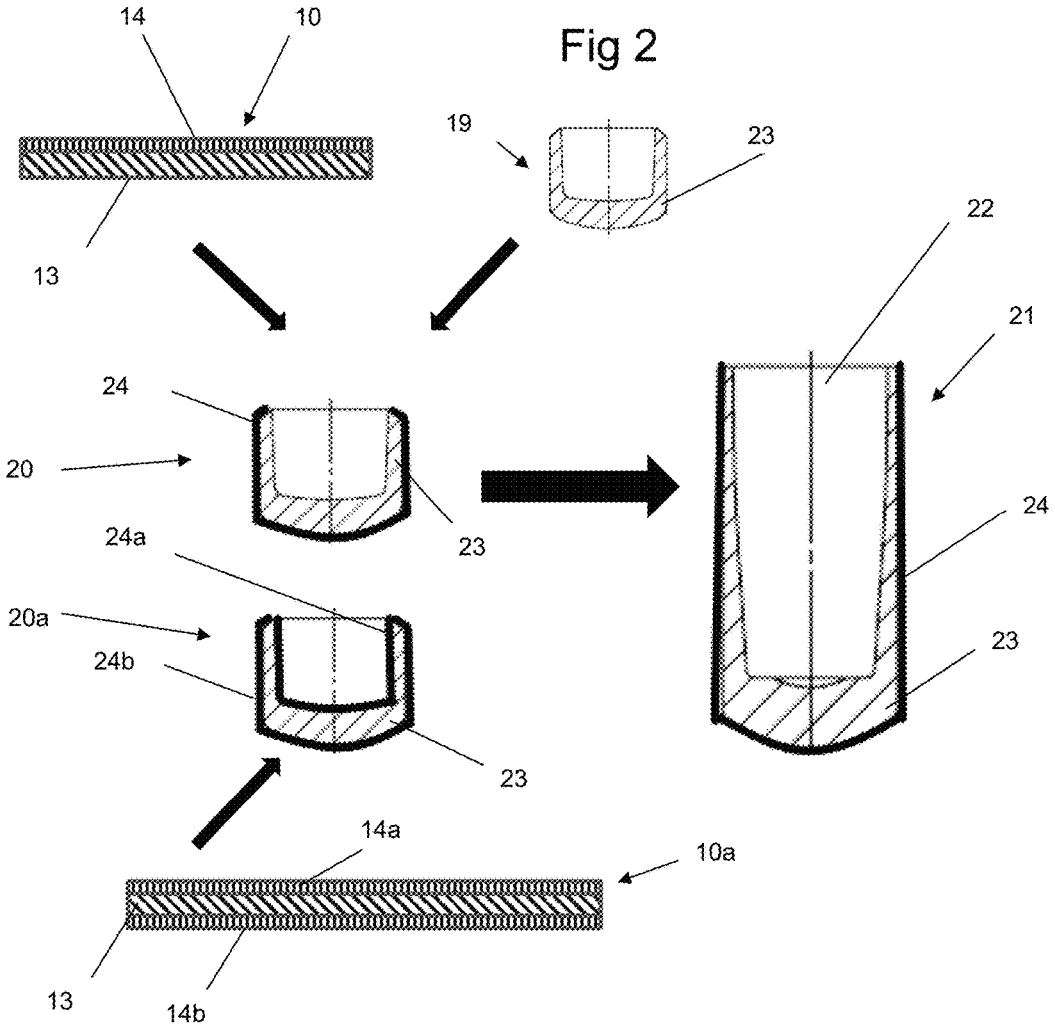
FIG. 2 shows a method of making the coated metallic projectile cup.

As shown in FIG. 2, there is provided a precursor stock material 10, such as a sheet of copper 13, with a deposed layer of decoppering agent 14 deposed thereon. Tin plating is a well known process, and the tin may be applied by any known method.

The precursor material 10 may be deformed, punched, pressed to provide a decoppering agent coated metallic projectile cup 20. The cup having a wall 23, with an outer layer of decoppering agent 24, deposed thereon. The cup may then be used directly in a draw process to provide elongated cup 21, which is ready to receive an inner core in opening 22. The walls 23 of the elongate cup, comprise the decoppering agent located on the outer surface of the walls 23.

Alternatively, the decoppering agent deposition may be applied to both surfaces of the precursor stock material. In an alternative arrangement the precursor stock material 10*a*, comprises a sheet of copper 13, with a deposed layer of decoppering agent 14*a*. 14*b* deposed on both sides. The subsequent processing into a metallic projectile cup 20*a* provides a metallic projectile cup which is enveloped with decoppering agent.

In an alternative arrangement, a ready formed metallic projectile cup 19, may be coated directly with a decoppering agent, either on just the outer surface to provide cup 20 or both the inner and outer surface to provide cup 20*a*.

Figure 3:
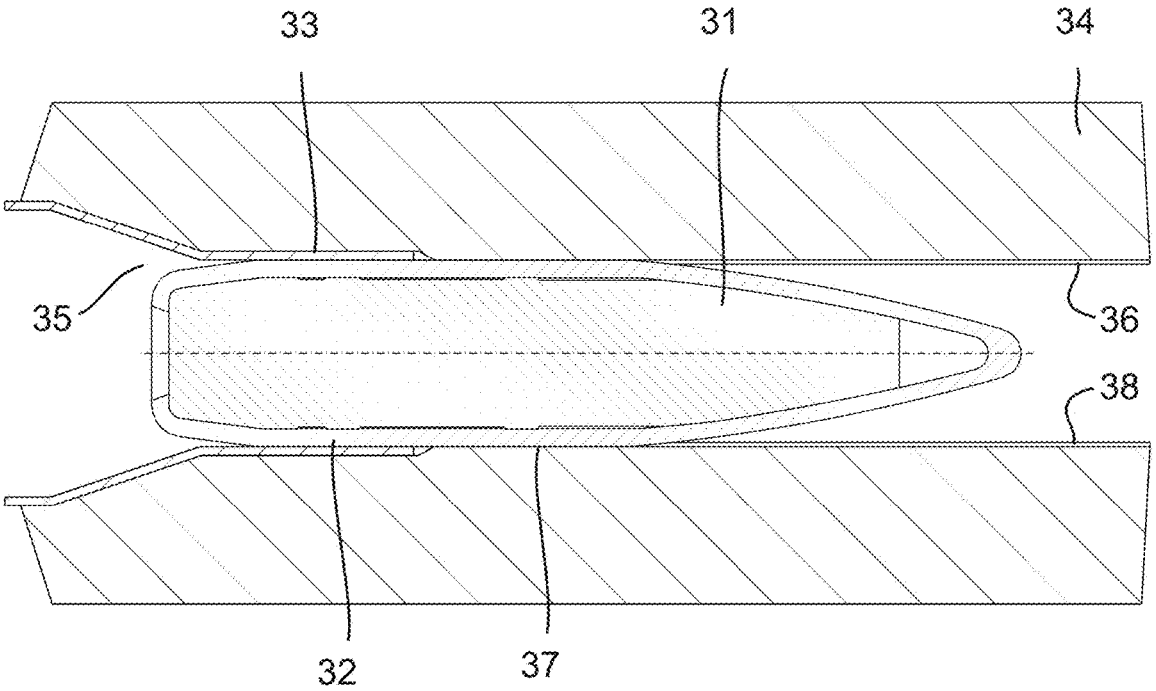
FIG. 3 shows a round located in a rifled barrel.

As shown in FIG. 3, in use the round of ammunition comprising the assembled primed and filled cartridge case 33, together with a projectile 31 are fired from a gun having a rifled barrel 34, in the conventional manner, i.e. by chambering the round within the gun chamber 35, and arranging for the primer cap (not shown) to be struck by a firing pin.

When the projectile passes from the gun chamber into the rifled part of the barrel, by virtue of its greater diameter, the inner core 39 becomes engraved by the rifling 37. The diameter of the monolithic body 39 and associated jacket 32 should preferably be substantially equal to or less than the diameter of the rifling grooves 36, 38.

The jacket 32 is of a malleable material which can be copper or a copper alloy and comprises a decoppering agent coated thereon. This jacket 32 is of a thickness greater than the depth of the rifling grooves, and is of a relatively softer material than that of the monolithic body 39, it can also engrave more readily, and thus contribute for this reason also to a reduction in the engraving force required. Because the jacket 32 is thicker than the depth of rifling, engraving can take place entirely within the coating so that the hard metal of the monolithic body 39 is kept substantially out of contact with the material forming the rifling of the gun barrel. Therefore, despite the hardness of the material forming the main part of the monolithic body 39, barrel wear from this factor is minimised.

Figure 4:
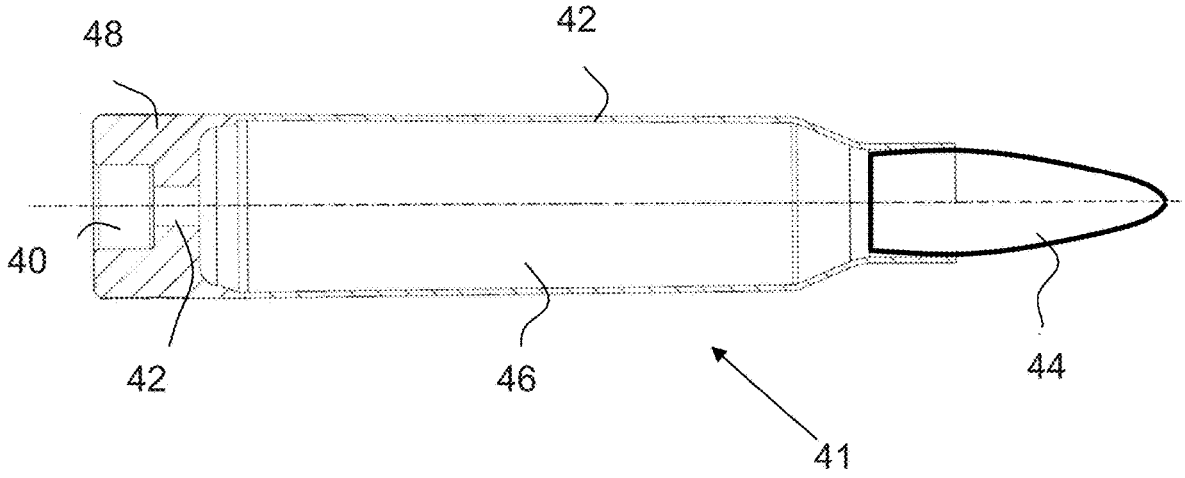
FIG. 4 shows a complete round with the projectile of the invention.

Turning to FIG. 4, a round 41 is shown. The cartridge assembly 41 comprises a casing 42 and a decoppering agent coated projectile 44. The casing 42 has a hollow section 46, which will contain propellant for displacement of the projectile 44. The casing 42 further comprises a head 48 at the end opposite to the projectile 44 which comprises a chamber 40 for a percussion cap (not shown), and a flash tube 42 for communication of an ignition charge from the percussion cap to the inside of the casing 42 and thus the propellant. The walls of the chamber 46 are formed integrally with the head 48. The walls 46 of the cartridge case chamber may also be plated with a decoppering agent, on the inner surface, outer surface or both. Such a cartridge casing may typically be formed of brass, steel or titanium.

The invention claimed is:

1. A method of manufacturing a decoppering agent coated metallic projectile for a rifled barrel, the method comprising:

coating a metallic projectile cup with a decoppering agent, to provide a coated metallic projectile cup; and causing the coated metallic projectile cup to be drawn through a first die, then drawn through at least a second die and then drawn over an inner core to form a drawn coated metallic projectile that comprises an outer jacket disposed over the inner core, the outer jacket derived from the coated metallic projectile cup and comprising the decoppering agent.

2. The method according to claim 1, wherein the thickness of the coating of the decoppering agent on the metallic projectile cup is in the range of from 0.10 microns to 100 microns.

3. The method according claim 2, wherein the thickness of the coating of the decoppering agent on the metallic projectile cup is in the range of from 5 microns to 15 microns.

4. The method according to claim 1, wherein the decoppering agent is tin.

5. The method according to claim 1, wherein the metallic projectile cup is gilding metal, copper or copper alloys thereof.

6. The method according to claim 1, wherein prior to coating the metallic projectile cup with the decoppering agent, the method further includes:

providing a precursor stock material with a coating of the decoppering agent located thereon, to provide a coated precursor stock material; and causing the coated precursor stock material to be formed into the coated metallic projectile cup, by one or more of rolling, drawing, extrusion, stamping.

7. The method according to claim 6, wherein the decoppering agent is applied to the precursor stock material or metallic projectile cup by one or more of electrolysis, electroless deposition, vapour deposition, chemical vapour deposition, co-depositing/alloying.

8. The method of claim 1, further comprising forming a coated metallic cartridge case for the coated metallic projectile, by:

coating a metallic cartridge cup with a decoppering agent, to provide a coated metallic cartridge cup; and causing the coated metallic cartridge cup to be drawn through a plurality of dies to form the drawn coated metallic cartridge case.

* * * * *